US005709367A

United States Patent [19]

Heintz et al.

[11] Patent Number: 5,709,367

[45] Date of Patent: Jan. 20, 1998

[54] EQUIPMENT SECURITY MOUNT

[75] Inventors: Kevin J. Heintz, Marine City; Peter T. Kennedy, Grosse Pointe Woods; Michael C. Kennedy, Harrison Township, all of Mich.; Robert T. Kennedy, Centerville, Ohio

[73] Assignee: ON-X International, Ltd., Clinton Twsp., Mich.

[21] Appl. No.: 616,891

[22] Filed: Mar. 18, 1996

[51] Int. Cl.[6] ..... E05B 65/00; E05B 73/00

[52] U.S. Cl. ..... 248/551; 248/553; 70/58; 70/232; 70/369; 70/DIG. 57

[58] Field of Search ..... 248/551, 553, 248/552, 499, 503, 680; 70/DIG. 57, 164, 232, 369, 368, 58

[56] References Cited

U.S. PATENT DOCUMENTS

| | | | |
|---|---|---|---|
| 3,757,549 | 9/1973 | Mullis, Jr. | 70/232 |
| 3,850,392 | 11/1974 | Gassaway . | |
| 4,022,036 | 5/1977 | Cebubar . | |
| 4,065,083 | 12/1977 | Gassaway . | |
| 4,613,109 | 9/1986 | Boscacci . | |
| 4,712,763 | 12/1987 | Leite . | |
| 4,739,637 | 4/1988 | Finkel et al. . | |
| 4,893,777 | 1/1990 | Gassaway . | |
| 5,433,094 | 7/1995 | Sandin et al. | 70/232 X |

FOREIGN PATENT DOCUMENTS

| | | | |
|---|---|---|---|
| 2134587 | 8/1984 | United Kingdom | 70/58 |

*Primary Examiner*—Leslie A. Braun
*Assistant Examiner*—Donald J. Wallace
*Attorney, Agent, or Firm*—Fildes & Outland, P.C.

[57] ABSTRACT

An equipment security mount for protecting computers or other equipment from unauthorized removal includes a base or pad adapted to be fixed to a mounting surface such as a desk top and a cover having a flange depending from a floor on which the equipment is mounted from below The cover is thereafter locked over the base to prevent removal of the equipment from the base and the base from the mounting surface. The base and cover are secured by lock pins engaging aligned lugs or straps in the base and cover and retained by locks fixed in lock openings in lock housings of the cover through which the lock pins are installed or removed. Preferably the improved cover is made from high strength resilient plastic with brass inserts in the housings which secure the locks and capture adjacent ends of the lock pins to deter removal by bending of the flange. Gussets and ribs connecting with the floor and with the lugs and/or lock housings and flange further strengthen the plastic housing against bending damage, thus protecting the mounted equipment from loss.

19 Claims, 3 Drawing Sheets

FIG-6
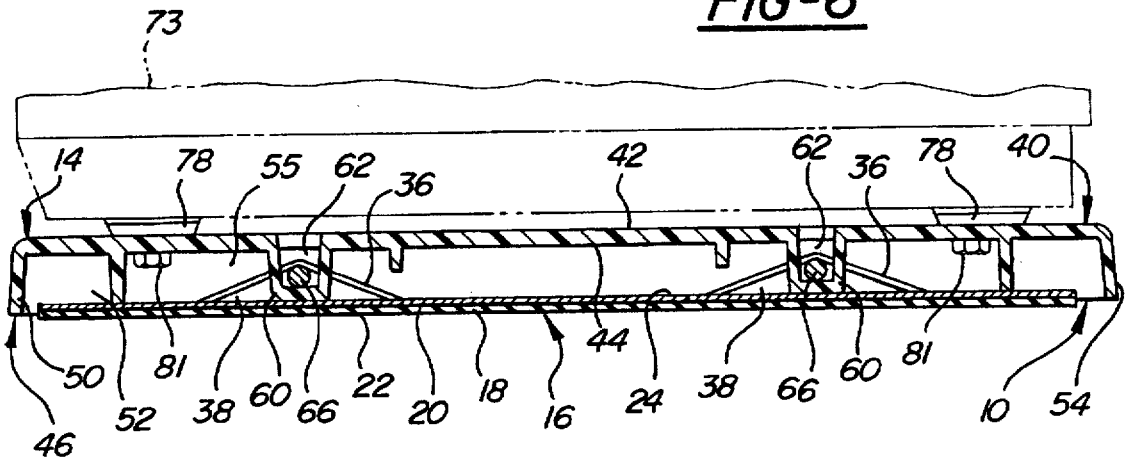
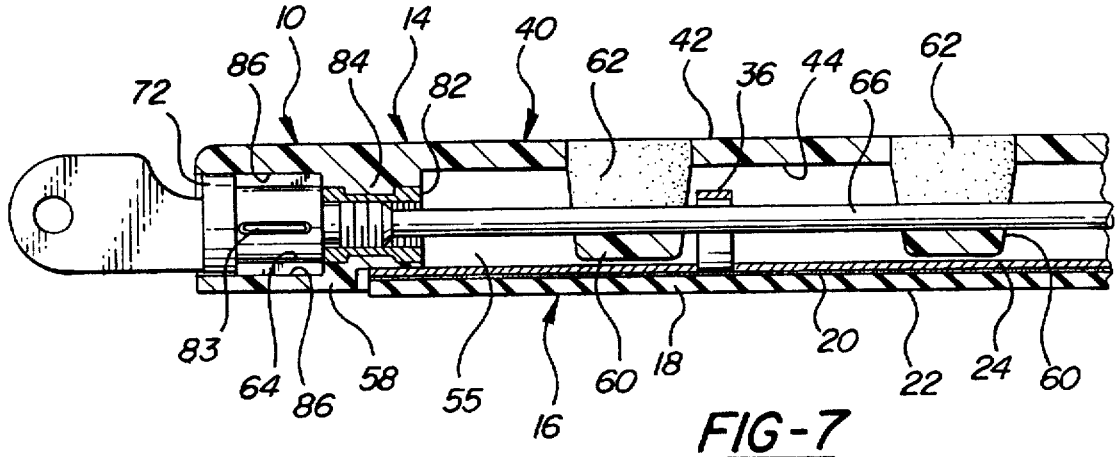
FIG-7
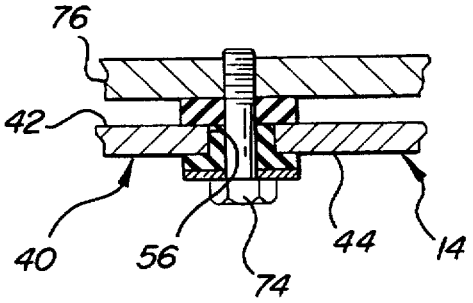
FIG-8
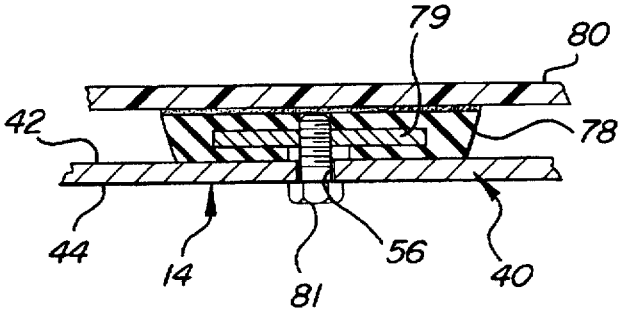
FIG-9

EQUIPMENT SECURITY MOUNT

FIELD OF THE INVENTION

This invention relates to security mounts for fastening equipment such as office equipment, for example computers, fax machines, typewriters, and other more or less similar equipment such as televisions, video cassette recorders, projectors, safes, microscopes and the like, to their mounting surfaces. More particularly the invention relates to such security mountings which are lockably attached to the mounting surface.

BACKGROUND OF THE INVENTION

It is known in the art to provide security mounts for office equipment and other similar items in order to prevent their unauthorized removal from a mounting surface such as a desk or table. One such device, commercial versions of which have been in use for many years, is disclosed in U.S. Pat. No. 3,850,392 issued Nov. 26, 1974. This prior mount includes a cover which encloses and is held by removable pins to a resilient pad which is adhesively mounted on a mounting surface. Equipment, such as a computer, is mounted on the cover from the inside prior to installation of the cover on the mounting pad. Locks, installed in an end wall or flange of the cover, block removal of the pins and thus prevent unauthorized removal of the equipment from the mounting surface.

In commercial versions of the prior mount, the cover has been made of an aluminum casting which may be subject to breaking when struck with a hammer. The lock mounting flange may then be removed allowing the pins to be withdrawn and the cover with the mounted equipment to be taken away. Other forms of security mounts, including some with formed steel casings or mounting covers, are believed to have met with less commercial success than that of the previously described arrangement.

SUMMARY OF THE INVENTION

The present invention provides a security mount having general features similar to those of the previously described mount but including a number of improvements which substantially increase the security of equipment protected by and mounted upon the security mount of the invention.

A feature of the invention is that the cover on which equipment is mounted is preferably made from a resilient high strength plastic having high impact resistance and a good memory, i.e. the ability to return to its original shape after being deformed. A high strength polycarbonate material is preferred for this application.

Another feature of the invention is that the lock housings are extended so that steel lock pins which retain the cover to the base or mounting pad extend into the inner end of the lock housings in the assembled condition. Thereby the steel lock pins support the ends of the lock housings and strengthen them and the connected flange of the cover against deformation and breakage.

A further feature is that ribs are provided within the cover to further strengthen the floor and surrounding flange structure against bending and breakage. These ribs may include longitudinal stiffening ribs between a lock mounting portion of the flange and an inner mounting surface of the floor, lateral ribs along the floor and between certain cover lugs, diagonal ribs along the floor linking the flange near the corners of the cover with adjacent lugs, and longitudinal ribs strengthening selected portions of the cover floor.

An additional feature is that brass or other metal bushings are preferably molded within the lock housings having threaded portions into which suitable lock mechanisms, such as wafer locks or pin locks are threaded for blocking access to and preventing removal of the lock pins. The ends of the lock pins extend into the threaded openings of the bushings to provide the additional support previously referred to.

These and other features and advantages of the invention will be more fully understood from the following description of certain exemplary embodiments of the invention taken together with the accompanying drawings.

BRIEF DESCRIPTION OF THE DRAWINGS

In the drawings:

FIG. 6 is a cross-sectional view from the line 6—6 of FIG. 1 showing in phantom equipment such as a computer fastened to the cover of FIG. 1;

FIG. 7 is a cross-sectional view from line 7—7 of FIG. 1 showing the application of a lock and a lock pin extending within the lock housing;

FIGS. 8 and 9 are cross-sectional views illustrating optional arrangements for attaching equipment to the cover.

DETAILED DESCRIPTION OF THE INVENTION

Figure 1:
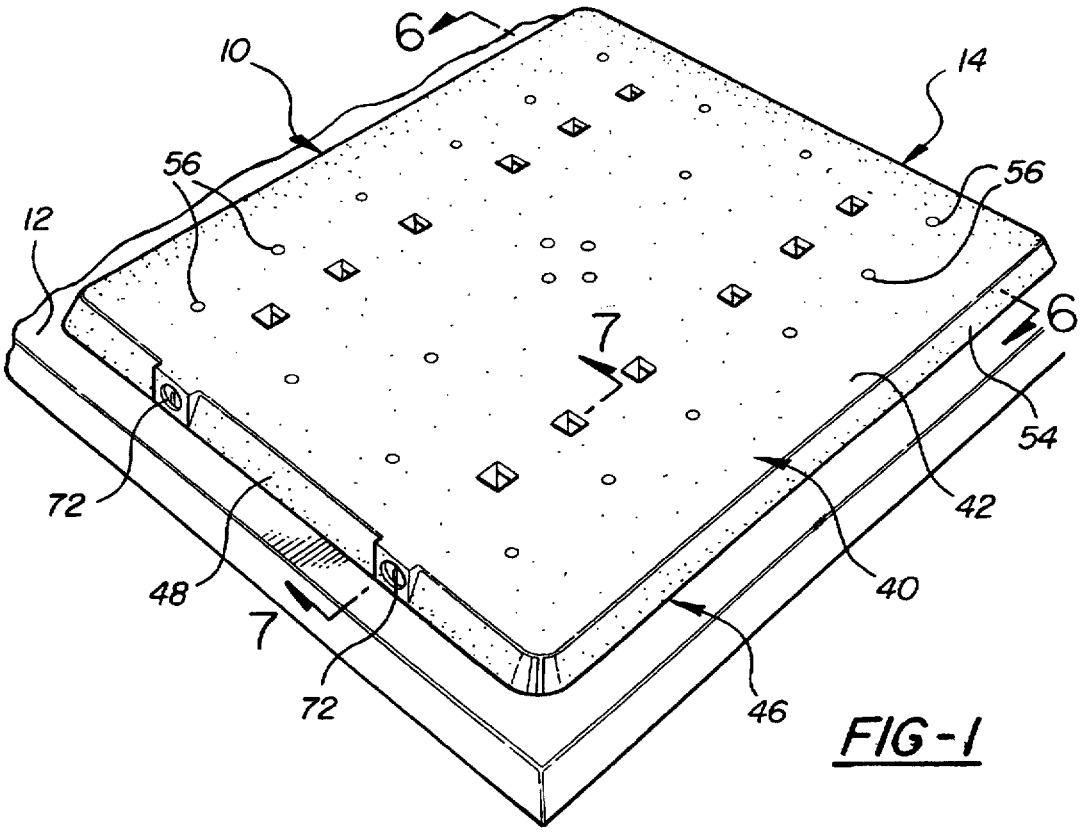
FIG. 1 is a pictorial view of an assembled security mount according to the invention shown mounted on a mounting surface.

Referring now to the drawings in detail, numeral 10 generally indicates an equipment security mount in accordance with the invention. Mount 10 comprises an assembly which is shown mounted upon a mounting surface 12 defined by a portion of a desk top or other suitable mounting surface.

Figure 2:
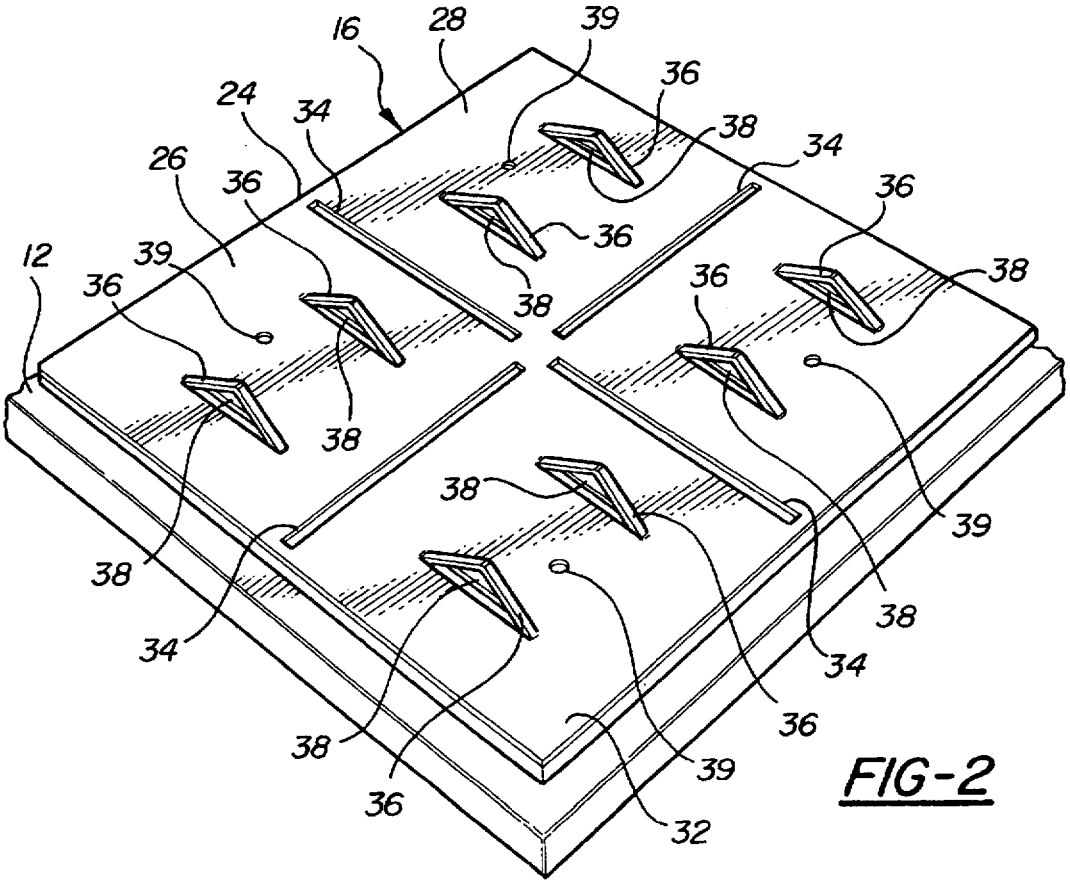
FIG. 2 is a pictorial view with the cover removed to show the pad assembly including mounting straps or lugs to which the cover is secured in assembly.
Figure 3:
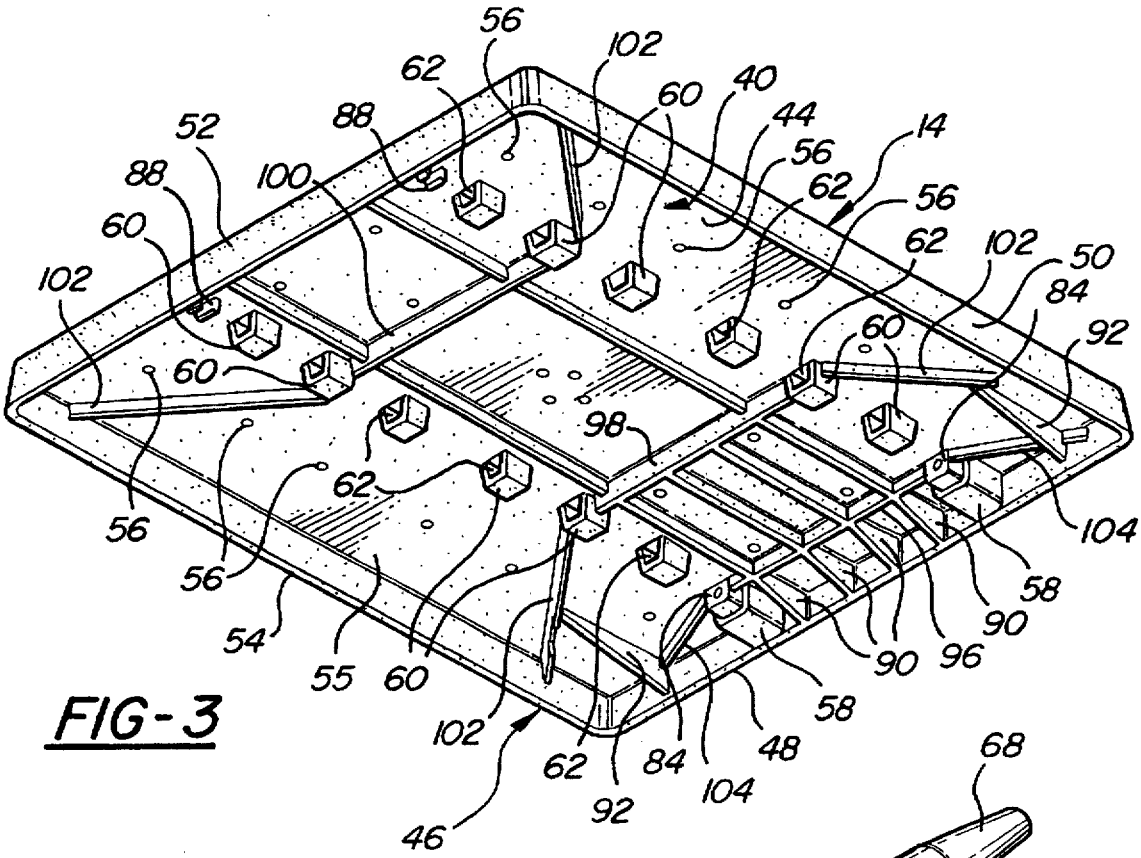
FIG. 3 is a pictorial view of the cover from below showing the pin supported lock housings and the rib-strengthened construction of the internal mounting cavity.
Figure 4:
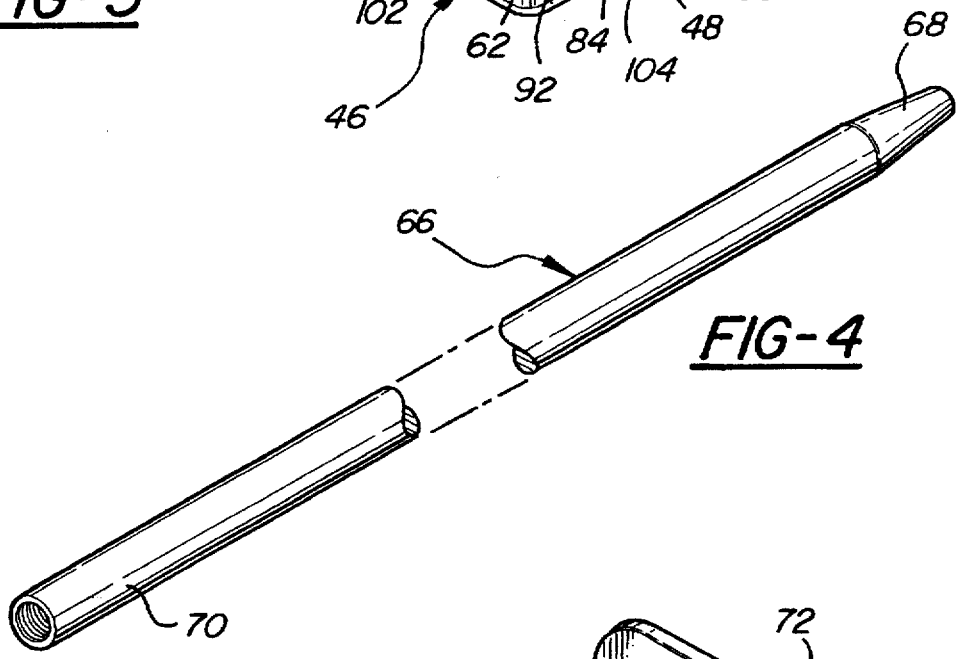
FIG. 4 illustrates one of the two lock pins which hold the cover to the pad assembly.
Figure 5:
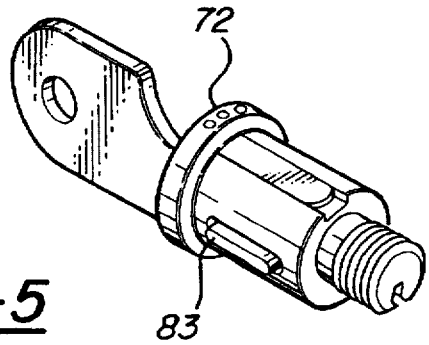
FIG. 5 illustrates one of the two locks which prevent removal of the lock pins from the cover.

Security mount 10 generally comprises a rectangular cover 14 secured to and enclosing a rectangular mounting pad 16 (see FIG. 2) which is adhesively secured to the desk top mounting surface 12. Pad 16 includes a sheet 18 of suitable material, preferably one which is pliable such as a foam material, for example plastic foam. An open cell foam material is believed preferable to closed cell foam. The top and bottom surfaces of the material 18 are coated with layers 20, 22 of permanent adhesive material.

There is adhered to the upper surface of the pad 16, by means of the adhesive layer 20, a metal sheet 24, formed of steel in the preferred embodiment illustrated. Sheet 24 is divided into four breakaway sections comprising metal plates 26, 28, 30, 32 forming four quadrants of the sheet 24. The plates are separated by slots 34 that extend short of the edges so that the plates are connected with one another at their corners in a manner that will allow them to break away from one another when deformed. Each of the plates is provided with a pair of upraised straps or lugs 36 forming collinear openings 38 aligned with the similar openings of one of the adjacent plates to form two parallel rows of straps or lugs 36 defining parallel rows of openings 38 above the surfaces of their respective plates.

Until the security mount 10 is ready to be used, the bottom adhesive layer 22 of the mounting pad 16 is covered with a protective sheet (not shown) of material such as plastic or fabric to protect the adhesive layer. Upon installation, the protective sheet is removed and the pad is applied to the mounting surface with pressure so that the lower adhesive layer 22 retains the pad 16 on the mounting surface 12.

In the described embodiment, mounting holes 39 are provided, one in each of the plates 26, 28, 30, 32, for optionally receiving suitable fasteners such as screws for fastening the pad 16 to the desk top or mounting surface 12 either as a supplement to or in place of the adhesive attachment. While the adhesive pad described is presently preferred for use as a base with the improved cover of the present invention, it is also contemplated that the new cover may be used with any other compatible form of pad or base, whether it is adhesively or otherwise mechanically attached to a mounting surface.

The cover 14 is molded from a resilient high impact strength plastic material, for example a polycarbonate, which is strong and has above average memory characteristics for returning to its original shape after deformation. A suitable polycarbonate resin for injection molding is identified as PC41 and yields a material with the nominal physical properties shown in Table A.

TABLE A

PC41 Nominal Physical Properties

| Property | Test Method | Value |
|---|---|---|
| Melt Flow, G/10 min, (300/1.2) | D-1238 | 12.0 |
| Notched Izod Impact Strength, ft lbs/in (J/M) | D-256 | 15 (801) |
| Tensile Strenqth @ Yield, psi (MPa) | D-638 | 9,000 (62) |
| Tensile Elongation, % | D-638 | 100 |
| Flexural Modulus, psi (MPa) | D-790 | 325,000 (2,241) |
| Flexural Strength, psi (MPa) | D-790 | 12,000 (83) |
| Heat Deflection Temperature @ 264 psi, 0 F. (0 C.) | D-648 | 265 (129) |
| Specific Gravity | D-792 | 1.2 |

The molded cover includes a generally flat and rectangular floor 40 having an upper surface 42 and a lower surface 44. Around the periphery of the floor 40 is a depending flange or skirt 46 comprising four connected sides 48, 50, 52, 54. The floor 40 and flange 46 define an internal recess or cavity 55 into which the base or pad 16 is received when the cover 14 is installed over it.

The floor 40 is preferably provided with a plurality of openings 56 for use in mounting equipment on the upper surface 42. Additional openings may be added as desired. Alternatively, the floor may be made without openings if desired and mounting holes may be provided where needed prior to installation of the equipment. Side 48 of the flange, which forms one of the narrow ends of the rectangular floor illustrated, is formed integral with a pair of lock housings 58 which extend inward from the side 48 and are integrally formed below the lower surface 44 of the floor 40. In longitudinal alignment with the lock housings 58 are two rows of aligned lugs 60 depending from the lower surface 44 of the floor and forming two rows of longitudinally aligned openings 62 which are also aligned with cooperating lock openings 64 extending longitudinally through the lock housings 58.

Steel lock pins 66 are provided which at assembly are inserted through the lock openings 64 into the aligned openings 62 of the lugs 60. The leading ends 68 of the lock pins are preferably tapered to aid in inserting them through the openings 64 and the trailing ends 70 are preferably internally threaded to aid in removal of the lock pins from the assembly. Conventionally, a left hand thread is provided for use with a left hand threaded tool, not shown, that is threaded into the trailing ends 70 of the lock pins to pull them out through the openings 64. Locks 72 are mountable within the lock openings 64 to prevent the lock pins 66 from being removed from the cover location.

Prior to installation of the cover 14 over the mounting pad 16, the equipment 73 that is to be protected by mounting upon the cover is installed on the upper surface 42 of the floor 40 by mounting in any suitable manner. Fasteners 74 may be applied from the lower surface 44 of the floor within the cover and extend with optional rubber cushioning through openings 56 provided in the floor into the body 76 of the associated equipment as shown in FIG. 8. Alternatively, mounting feet 78 formed of molded rubber each encasing a threaded mounting washer 79 may be adhesively affixed to the equipment body 80 and secured by fasteners 81 to the floor 40 as shown in FIGS. 6 and 9.

Assembly of a security mount as so far described is essentially similar to that of the previously mentioned prior art arrangement. The mounting pad 16 is first adhesively mounted to a mounting surface 12 such as a desk top and then the cover 14 is laid over the mounting pad 16. As assembled, the flange 46 encloses the outer periphery of the pad 16 and the lugs 60 of the cover extend in interlocking fashion with the straps or lugs 36 of the mounting pad so that the openings 38 of the pad align with the openings 62 of the cover. The lock pins 66 are then installed through the lock openings 64 to extend through the aligned openings 38, 64 and prevent, by contact with the lugs 62 and straps 36, removal of the cover from the mounting pad. Installation of the locks 72 in the lock openings 64 thereafter prevents the lock pins 66 from being removed and therefore prevents unauthorized removal of the cover and any equipment that may be mounted thereon.

Except for the molded plastic material of the cover previously described, the elements of the security mount so far described are generally similar to those of prior commercial embodiments having a cast aluminum cover. The present invention, however, adds to the improved molded plastic cover certain additional structural modifications which add to the strength and resistance to removal of the improved cover as compared to the cast aluminum cover of the prior art.

Among the improved structural features of the present invention is the provision of molded in brass metal bushings or sleeves 82 in the inner ends 84 of the lock pin openings 64. Also, the inner ends 84 are extended inward slightly beyond the ends of the associated locks 72 to provide open recesses in the inner ends 84 of the lock openings 64 that are not filled by the locks when installed. The bushings 82 are threaded to engage threaded outer ends of the locks 72 which are preferred for use in the assembly and which are commercially available. The illustrated locks are three pin locks which actuate side lock bars 83. Alternatively, the lock openings may be formed to utilize wafer type locks, not shown. In either case, the locks are threaded into the associated bushings 82 and are locked in place upon removal of the key by the lock bar 83 or wafers engaging recesses 86 provided in the outer portions of the lock openings and configured to match the particular type of lock being used.

The cover 14 is additionally provided with stops 88 located inward from side 52 of the flange 46 and aligned with the lock pins 66 when installed. The stops 88 limit the travel of the lock pins toward the distal end of the cover and require that the trailing ends 70 of the lock pins remain within the bushings 82 in the inner ends 84 of the lock openings. In this way, the steel lock pins 66 help support the inner ends of the lock housings 58 and add strength to the assembly which prevents the lock containing side 48 of the flange 46 from being easily deformed in an attempt to remove the cover without removing the locks.

Additional means for strengthening the cover, especially adjacent the lock housings and the side 48 of the flange associated therewith, are provided by ribs in the recess 55 formed by the lower surface 44 of the floor and the surrounding flange 46. These ribs include gussets 90 extending longitudinally from the lower edge of side 48 to the lower surface 44 of the floor at locations intermediate the lock housings 58. Additional gussets 92 extend longitudinally from the side 48 to the floor lower surface 44 between the lock housings and the outer sides 50, 54 of the flange.

Transverse ribs 96, 98, 100 are provided across middle portions of the floor lower surface 44 Rib 96 extends between inner ends 84 of the laterally spaced lock housings 58 and intersects the longitudinal gussets 90. Ribs 98 and 100 extend between central pairs of the spaced lugs 60 which are located at assembly between the straps 36 of each of the plates 26, 28, 30, 32 to strengthen the floor 40 at these locations. Additionally, diagonal ribs 102 extend from each of these lugs diagonally toward the flange 46, intersecting the sides 50, 54 at locations spaced near the corners of the flange. Additional diagonal ribs 104 extend from the inner ends 84 of the lock housings outwardly to intersect the side 48 for additional support, intersecting also the gussets 92 near their connection with the side 48.

All of these strengthening features of the improved high strength plastic cover provided in accordance with the present invention add to the improved ability of this security mount assembly to prevent removal of equipment mounted on the cover by breaking of the cover or the mounting assembly with the tools often used for such purposes. Tests of the improved cover design have indicated a significant increase in security with an expected comparable increase of customer satisfaction With the improved product. When the resilient cover of this invention is used with the known pad 16 having a metal sheet 24 with breakaway plates as described, the combination is very effective in preventing removal of the cover from the pad and the pad from a mounting surface.

While the invention has been described by reference to various specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. Equipment security mount including a base having a top surface and a bottom surface and adapted to be secured to a mounting surface, means for attaching said bottom surface to said mounting surface, and a plurality of base lugs fixed to and extending upward from said top surface and providing a plurality of aligned base openings above the top surface; a cover having a floor with an upper surface, a lower surface and a peripheral flange depending from outer edges of said floor to form a downwardly open recess within said flange, said base being received within the recess when the cover is installed so that the base is essentially exposed only to the mounting surface and to the recess within the cover; equipment attaching means for attaching to said upper surface equipment to be protected from removal, said equipment attaching means being detachable from the equipment only from said lower surface within said recess; a plurality of cover lugs fixed to and depending from said floor and providing a plurality of aligned cover openings below the lower surface and positioned to be aligned with said base openings when the cover is installed over the base; at least one lock pin extending when installed through the aligned base and cover openings to prevent removal of the cover from the base; a lock housing connecting with said flange and including a lock opening extending through the lock housing in alignment with said cover openings, said pin being removable through said lock opening; and a lock lockable within said lock opening to prevent removal of said pin from said base and cover openings; characterized by:

said cover being at least partially formed from a high strength resilient plastic material that will deform without breaking and thereby resist forcible removal of the security mount when the cover is locked to the base; and, positioning means on said cover and operative to locate said lock pin when installed so that one end of the pin remains within said lock opening when the lock is installed, thus providing additional support against deflection of the lock housing and deformation of the flange adjacent to the lock housing.

2. The invention of claim 1 characterized by first longitudinal stiffening ribs within said recess and connecting said cover floor with said flange along a side of the flange with which said lock housing is connected to stiffen the flange and prevent its being easily deformed in the portion adjacent to the lock opening.

3. The invention of claim 2 characterized by first lateral stiffening ribs depending from said cover floor and connecting it with said lock housing adjacent the portion of said lock opening in which said one end of the pin is captured when assembled to strengthen the security of said pin within said lock opening.

4. The invention of claim 3 characterized by second longitudinal and lateral stiffening ribs depending from said lower surface of the cover to stiffen the cover against deformation, said lateral stiffening ribs connecting with at least some of said cover lugs to increase the strength of their support of said pin when installed.

5. The invention of claim 1 characterized by a metallic bushing mounted in said lock housing and forming the portion of said lock opening in which said one end of the pin is captured when assembled, said bushing also including means for engagement with said lock for retaining the lock in the lock opening when locked.

6. The invention of claim 1 characterized in that said plastic material is a polycarbonate.

7. The invention of claim 6 characterized in that said polycarbonate is formed from a resin essentially equivalent to PC41.

8. The invention of claim 1 characterized in that said base and said cover have lugs forming two rows of said aligned cover and base openings aligned with two of said lock openings in respective lock housings and receiving when assembled two of said lock pins, said lock housings being connected with said flange in laterally spaced relation along one of said sides, and two of said locks lockable in said housings for retaining said lock pins in assembly with said base and cover.

9. The invention of claim 8 characterized by first longitudinal stiffening ribs connecting said cover floor with said flange along said one side of the flange between said lock housings to stiffen the flange and prevent its being easily deformed or broken in the portion between the lock openings.

10. The invention of claim 9 characterized by first lateral stiffening ribs depending from said cover floor and extending between said lock housings adjacent the portion of said lock openings in which said one ends of said pins are captured when assembled to strengthen the security of said pins within said lock openings.

11. The invention of claim 10 characterized by second longitudinal and lateral stiffening ribs depending from said cover floor to stiffen the cover against deformation, said lateral stiffening ribs connecting with at least some of said cover lugs to increase the strength of their support of said pins when installed.

12. The invention of claim 8 characterized by metallic bushings mounted in said lock housings and forming the portions of said lock openings in which said one ends of the pins are captured when assembled, said bushings also including means for engagement with said locks for retaining the locks in the lock openings when locked.

13. A cover for an equipment security mount including a base having a top surface and a bottom surface and adapted to be secured to a mounting surface, means for attaching said bottom surface to said mounting surface, and a plurality of base lugs fixed to and extending upward from said top surface and providing a plurality of aligned base openings above the top surface; said cover having a floor with an upper surface, a lower surface and a peripheral flange depending from outer edges of said floor to form a downwardly open recess within said flange, said base being received within the recess when the cover is installed so that the base is essentially exposed only to the mounting surface and to the recess within the cover; equipment attaching means for attaching to said upper surface equipment to be protected from removal; a plurality of cover lugs fixed to and depending from said floor and providing a plurality of aligned cover openings below the lower surface and positioned to be aligned with said base openings when the cover is installed over the base; at least one lock pin extending when installed through the aligned base and cover openings to prevent removal of the cover from the base; a lock housing connecting with said flange and including a lock opening extending through the lock housing in alignment with said cover openings, said pin being removable through said lock opening; and a lock lockable within said lock opening to prevent removal of said pin from said base and cover openings; characterized by:

said cover being at least partially formed from a high strength resilient plastic material that will deform without breaking and thereby resist forcible removal of the security mount when the cover is locked to the base; and, positioning means on said cover and operative to locate said lock pin when installed so that one end of the pin remains within said lock opening when the lock is installed, thus providing additional support against deflection of the lock housing and deformation of the flange adjacent to the lock housing.

14. The invention of claim 13 characterized by first longitudinal stiffening ribs within said recess and connecting said cover floor with said flange along a side of the flange with which said lock housing is connected to stiffen the flange and prevent its being easily deformed in the portion adjacent to the lock opening.

15. The invention of claim 14 characterized by first lateral stiffening ribs depending from said cover floor and connecting it with said lock housing adjacent the portion of said lock opening in which said one end of the pin is captured when assembled to strengthen the security of said pin within said lock opening.

16. The invention of claim 15 characterized by second longitudinal and lateral stiffening ribs depending from said lower surface of the cover to stiffen the cover against deformation, said lateral stiffening ribs connecting with at least some of said cover lugs to increase the strength of their support of said pin when installed.

17. The invention of claim 13 characterized by a metallic bushing mounted in said lock housing and forming the portion of said lock opening in which said one end of the pin is captured when assembled, said bushing also including means for engagement with said lock for retaining the lock in the lock opening when locked.

18. The invention of claim 13 characterized in that said plastic material is a polycarbonate.

19. The invention of claim 18 characterized in that said polycarbonate is formed from a resin essentially equivalent to PC41.

* * * * *